US006566977B2

(12) United States Patent
Tsujiguchi

(10) Patent No.: US 6,566,977 B2
(45) Date of Patent: May 20, 2003

(54) FILTER, DUPLEXER, AND COMMUNICATION DEVICE

(75) Inventor: Tatsuya Tsujiguchi, Nagaokakyo (JP)

(73) Assignee: Murata Manufacturing Co. Ltd. (JP)

( * ) Notice: Subject to any disclaimer, the term of this patent is extended or adjusted under 35 U.S.C. 154(b) by 50 days.

(21) Appl. No.: 09/773,988

(22) Filed: Feb. 1, 2001

(65) Prior Publication Data

US 2001/0006362 A1 Jul. 5, 2001

(30) Foreign Application Priority Data

Feb. 1, 2000 (JP) ..... 2000-023714
Dec. 8, 2000 (JP) ..... 2000-374240

(51) Int. Cl.[7] ..... H01P 1/203; H01P 1/20

(52) U.S. Cl. ..... 333/134; 333/204

(58) Field of Search ..... 333/204, 203, 333/134, 202

(56) References Cited

U.S. PATENT DOCUMENTS 2,964,718 A * 12/1960 Packard ..... 333/204
4,963,843 A * 10/1990 Peckham ..... 333/203
6,127,906 A * 10/2000 Brooks et al. ..... 333/204

* cited by examiner

*Primary Examiner*—Robert Pascal
*Assistant Examiner*—Stephen E. Jones
(74) *Attorney, Agent, or Firm*—Dickstein, Shapiro, Morin & Oshinsky, LLP.

(57) ABSTRACT

A coplanar resonator comprising first center electrodes each having open ends and a ground electrode which extends along either side thereof is formed on the upper plane of a dielectric substrate, and second center electrodes and a perimeter electrode are formed on the lower plane of the dielectric substrate, so as to face the above center electrodes and ground electrode. A filter, duplexer, and communication device using this resonator are provided, thereby reducing the size of the resonator part formed of electrode patterns on a dielectric substrate, facilitating reduction in size of the overall device, and increasing no-load Q.

9 Claims, 19 Drawing Sheets

FILTER, DUPLEXER, AND COMMUNICATION DEVICE

BACKGROUND OF THE INVENTION

1. Field of the Invention

The present invention relates to a coplanar line filter configured with coplanar resonators provided upon a dielectric substrate, a duplexer, and a communication device using the same.

2. Description of the Related Art

FIGS. 22A through 22C illustrate an example of a configuration of a coplanar line filter using a conventional coplanar resonator. FIG. 22A is a plan view of the dielectric substrate, FIG. 22B is a bottom view thereof, and FIG. 22C is a side view thereof. Formed on the upper side of the dielectric substrate 1 are center electrodes 2*a* and 2*b* having open ends, and a ground electrode 3 following the sides of these center electrodes. In the diagram, the arrows represent the electric field distribution. Due to such a structure, the center electrode 2*a* and the ground electrode 3 serve as one coplanar resonator, and the center electrode 2*b* and the ground electrode 3 serve as the other coplanar resonator. Further, these two coplanar resonators are coupled electromagnetically, thereby acting as a filter formed of two stages of resonators.

Generally, coplanar resonators forming a filter can comprise short-circuit portions and can be disposed on a single plane of a dielectric substrate, so reduction in size can be realized by utilizing ¼ wavelength resonators. However, the amount of leakage of the electromagnetic field distribution in the resonating mode out from the dielectric substrate may be relatively great, i.e., the effective dielectric constant tends to be low, so there has been a limit to the reduction in size that is available.

Also, as shown in FIGS. 22A through 22C, the electric field heads from the center electrodes toward the ground electrode on either side, so the electric field is concentrated at the ends of the center electrodes. Consequently, there has been a problem in that a high no-load Q cannot be obtained.

SUMMARY OF THE INVENTION

The present invention provides a coplanar line filter, duplexer, and communication device using the same, wherein reduction in size of the entire article is facilitated, and no-load Q is increased.

To this end, the coplanar line filter according to the present invention comprises: a dielectric substrate having an upper plane and a lower plane; a coplanar resonator provided upon the upper plane of the dielectric substrate, the coplanar resonator comprising a first center electrode wherein an end thereof is an open end, and a ground electrode with a predetermined gap provided from the first center electrode; a second center electrode provided on the lower plane of the dielectric substrate, formed so as to face the first center electrode through the dielectric substrate; and a perimeter electrode provided on the lower plane of the dielectric substrate, formed so as to face the ground electrode through the dielectric substrate.

As will become apparent from the later-described embodiments, the center electrode patterns on the upper and lower sides of the dielectric substrate are mutually electromagnetically linked so as to act as a ring resonator (a balanced resonator), so the resonance frequency decreases. On the other hand, the dimensions of the electrode patterns and the dimensions of the dielectric substrate for obtaining a predetermined resonance frequency are reduced.

Further, resonance mode electromagnetic fields facing in the upper and lower directions from the dielectric substrate reduces the deterioration of no-load Q (hereafter referred to as "Qo") due to the edge effect (electric-field concentration at the electrode edges), thereby obtaining a high Qo.

The duplexer according to the present invention comprises: a transmission filter comprising a coplanar line filter according to the present invention; and a reception filter comprising a coplanar line filter according to the present invention. Thus, high Qo and low insertion loss properties are obtained with an overall small size.

The communication device according to the present invention comprises one or more of the above filters or duplexer arranged for processing transmission signals or reception signals in a high-frequency circuit for example, thereby obtaining high electric usage efficiency properties with a small size.

Other features and advantages of the present invention will become apparent from the following description of embodiments of the invention which refers to the accompanying drawings, in which like references denote like elements and parts.

DESCRIPTION OF EMBODIMENTS OF THE INVENTION

Figure 1A:
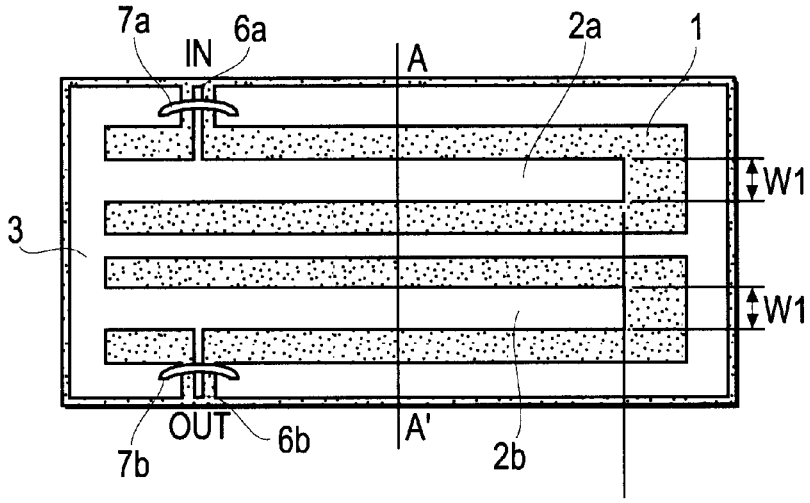
FIGS. 1A through 1C are diagrams illustrating the configuration of a filter according to a first embodiment.
Figure 1C:
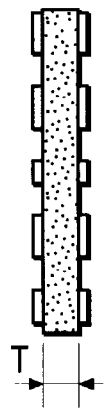
Figure 1B:
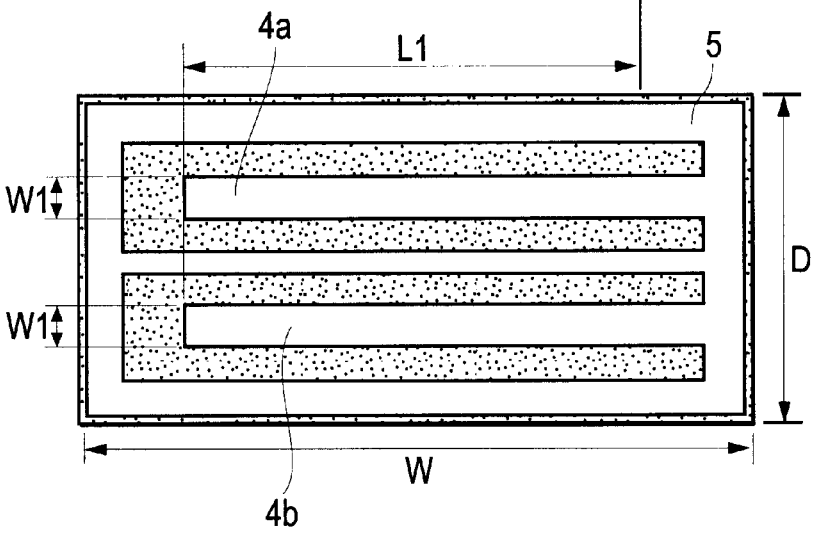

FIGS. 1A through 1C illustrate the configuration of a filter according to a first embodiment. FIG. 1A is a plan view of the dielectric substrate, FIG. 1B is a see-through view thereof showing the patterns on the lower side viewed from above, and FIG. 1C is a cross-sectional view thereof of the portion along line A-A'.

Formed on the upper side of the dielectric substrate 1 are mutually parallel first center electrodes 2*a* and 2*b* with respective line widths of W1 and having open ends, and a ground electrode 3 distanced from these first center electrodes by a predetermined distance. Also formed are input/output electrodes 6*a* and 6*b* extending outwards from predetermined portions on the first center electrodes 2*a* and 2*b*. The input/output electrodes 6*a* and 6*b* and the ground electrode 3 form respective coplanar lines.

Formed on the lower side of the dielectric substrate 1 are second center electrodes 4*a* and 4*b* and a perimeter electrode 5, at positions facing the first center electrodes 2*a* and 2*b* and the ground electrode 3 on the upper plane, respectively. Note, however, that according to the present example, the electrode patterns are formed with the short-circuit ends of the first center electrodes 2*a* and 2*b* on the upper side of the dielectric substrate 1 and the short-circuit ends of the second center electrodes 4*a* and 4*b* on the lower side of the dielectric substrate 1 facing in opposite directions. The length where the first center electrodes 2*a* and 2*b*, and second center electrodes 4*a* and 4*b* overlap is represented as L1.

Also, the ground electrodes on either side of the input/output electrodes 6*a* and 6*b* are connected with wires 7*a* and 7*b*. These portions may be connected with air bridges instead. According to such a structure, the ground potential on either side of the input/output electrodes 6*a* and 6*b* is equalized, and the input/output electrode portion is operated as a coplanar line in a stable manner.

Figure 2A:
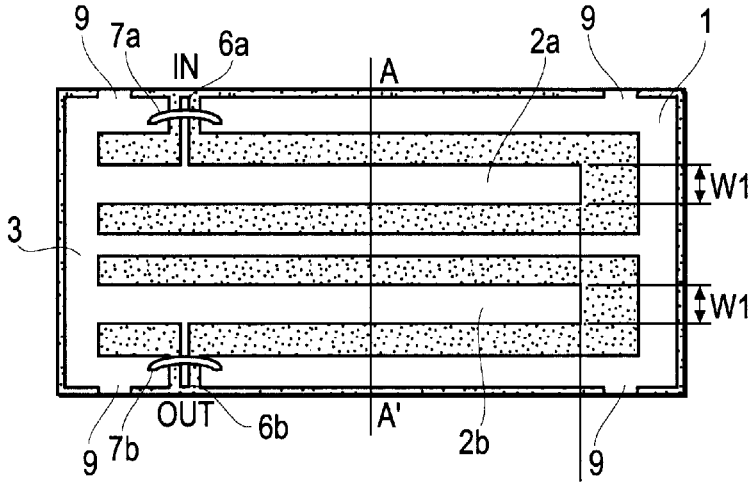
FIGS. 2A through 2C are diagrams illustrating another configuration example of the filter.
Figure 2C:
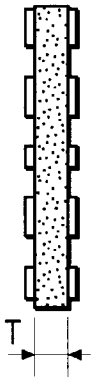
Figure 2B:
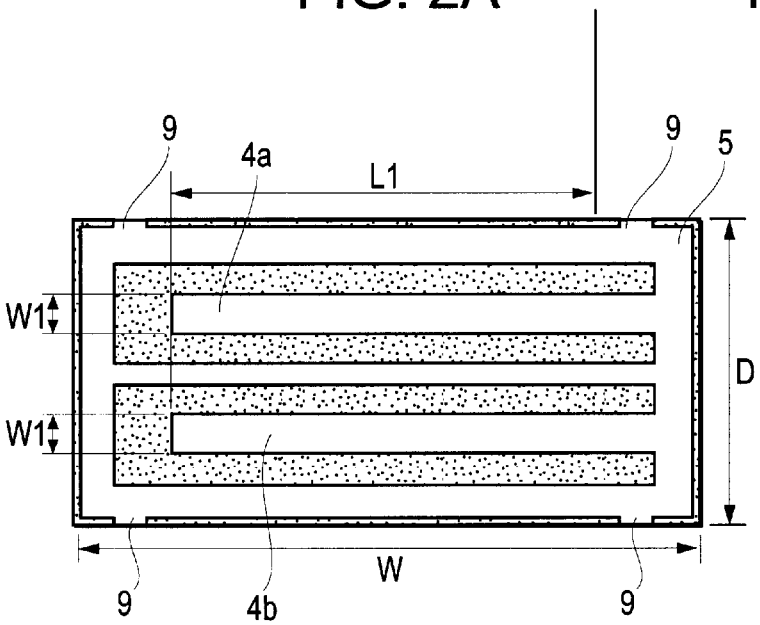

FIGS. 2A through 2C illustrate another configuration example. In the example shown in FIGS. 1A through 1C, the ground electrode 3 and the perimeter electrode 5 on the dielectric substrate 1 are independent, but a side electrode 9 may be formed on the side of the dielectric substrate 1 so as to connect the ground electrode 3 and the perimeter electrode 5, as shown in FIGS. 2A through 2C. Due to this structure, the potential of the perimeter electrode 5 on the lower side of the dielectric substrate becomes equal to the ground potential, and a stable resonant mode can be obtained.

Figure 3A:
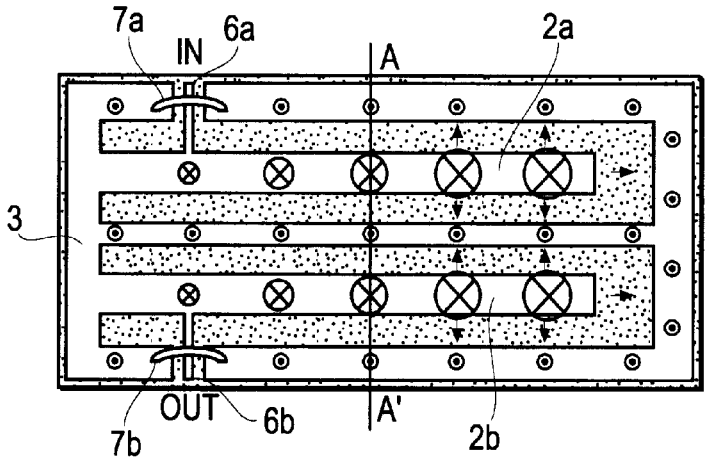
FIGS. 3A through 3C are diagrams illustrating the resonance mode of the filter by electric field distribution.
Figure 3C:
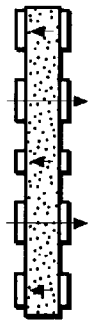
Figure 3B:
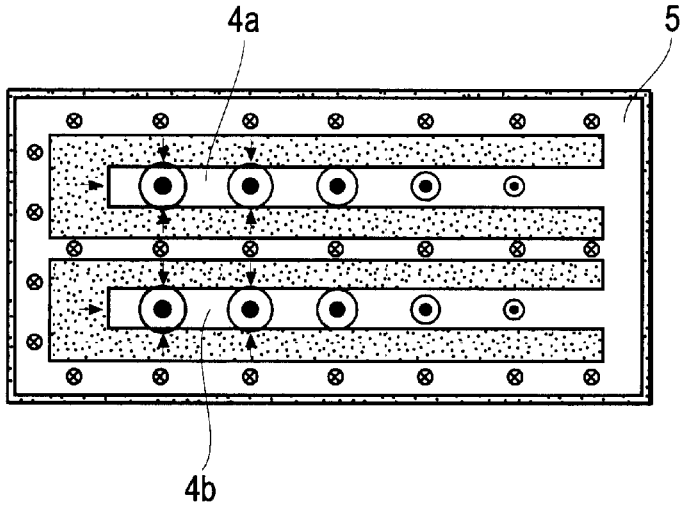
Figure 4A:
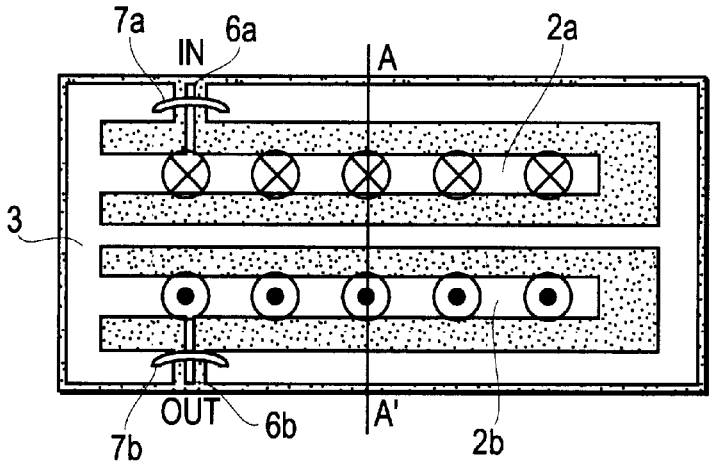
FIGS. 4A through 4C are diagrams illustrating the resonance mode of the filter by electric field distribution.
Figure 4C:
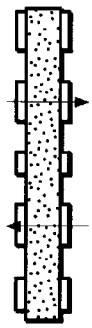
Figure 4B:
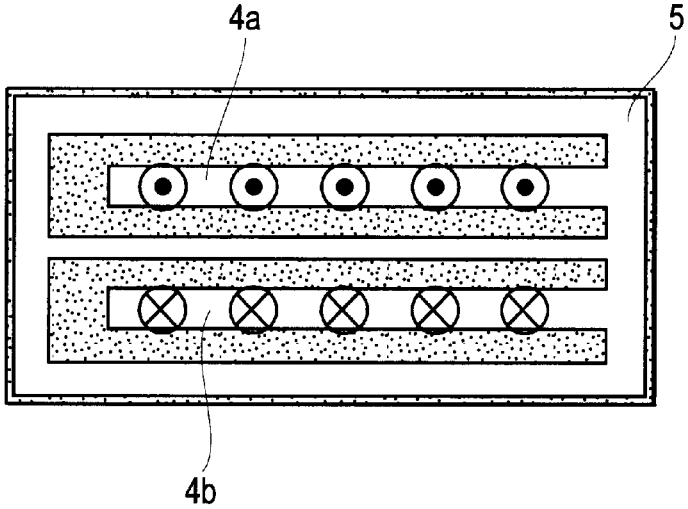
Figure 22A:
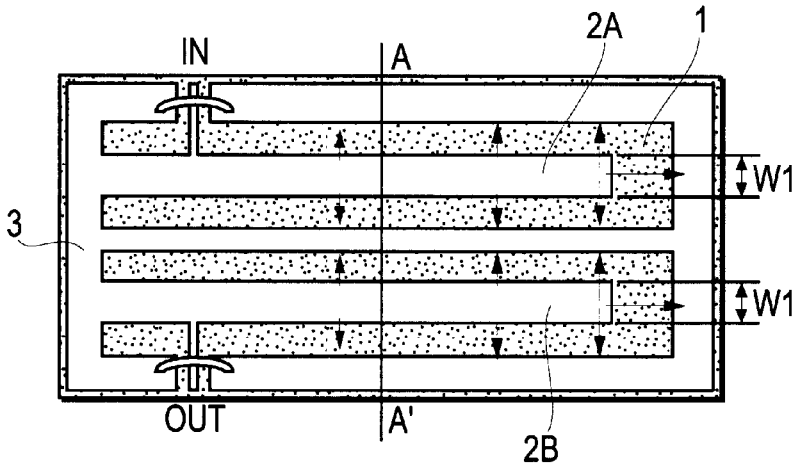
FIG. 22A PRIOR ART
FIGS. 22A through 22C are configuration diagram illustrating a conventional filter.
Figure 22C:
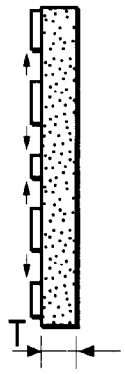
FIG. 22C PRIOR ART
Figure 22B:
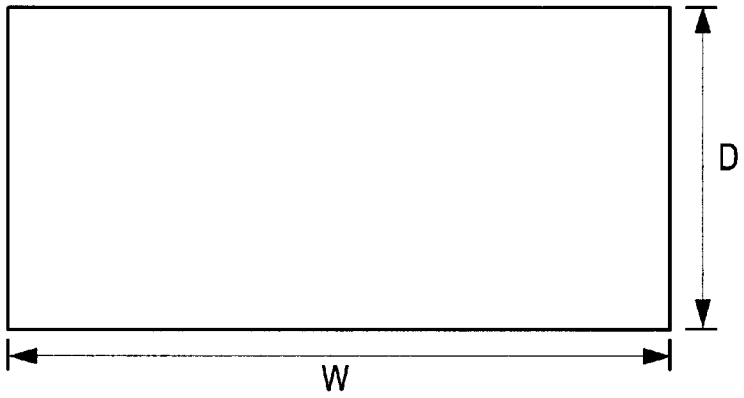
FIG. 22B PRIOR ART

FIGS. 3A through 4C are diagrams showing examples of electric field distribution of the filters shown in FIGS. 1A through 2C. FIGS. 3A through 3C show the electric field distribution in the even mode, and FIGS. 4A through 4C show the electric field distribution in the odd mode. It can be clearly understood in light of comparison with the filter using the conventional coplanar resonator shown in FIGS. 22A through 22C that with the conventional coplanar resonator the direction of the electromagnetic field is between the center electrode and the ground electrode on either side of it, but with the resonator according to the present invention the direction of the electromagnetic field is primarily between the upper and lower planes of the dielectric substrate. Accordingly, the concentration of electric field at the end portions of the first center electrodes 2*a* and 2*b* is alleviated, and deterioration of Qo due to the edge effect is suppressed.

Also, the first and second center electrode portions on the upper and lower planes of the dielectric substrate are mutually electromagnetically coupled to serve as a ring resonator (a balanced resonator), so the resonance frequency is lower than that in an arrangement configured with a conventional coplanar resonator. That is to say, is this embodiment of the invention, each of the center electrodes, in each adjacent pair of center electrodes on the upper and lower planes serves as a half-wavelength resonator. The open ends of the half-wavelength resonators on the upper plane and the lower plane are coupled by electric fields in the vertical direction, and act just as a ring resonator. Here, the resonance frequency drops, since the effective dielectric constant is higher and the line length is longer than arrangements comprising coplanar lines.

Figure 5A:
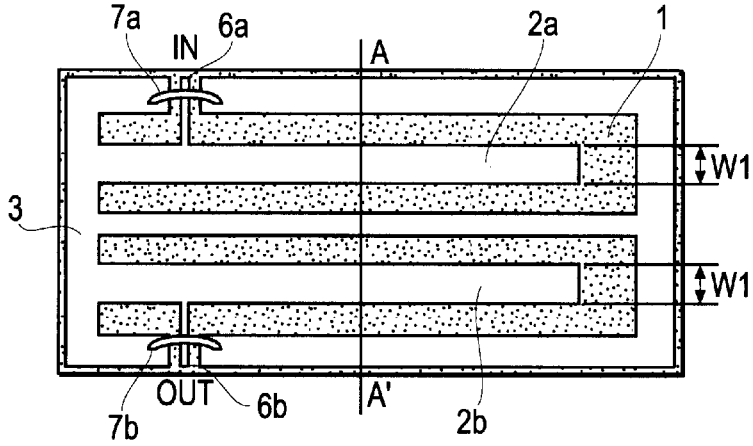
FIGS. 5A through 5C are configuration diagrams illustrating a filter according to a second embodiment.
Figure 5C:
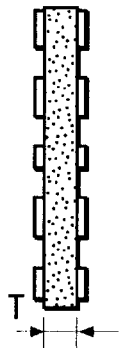
Figure 5B:
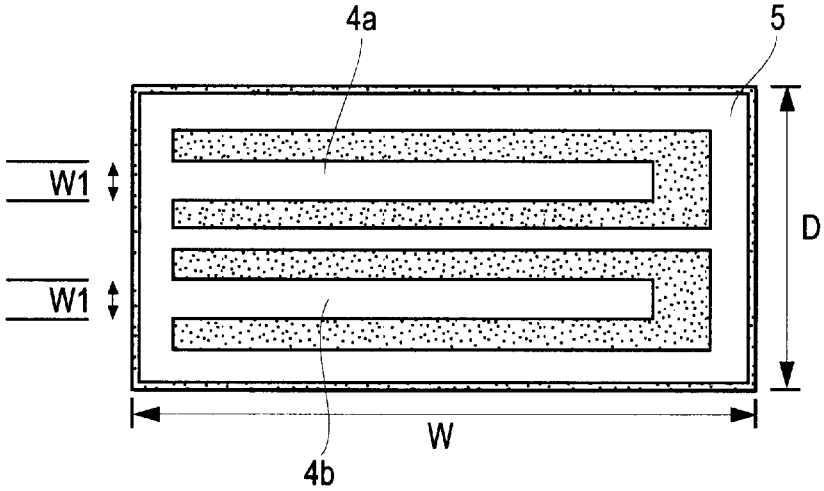

Next, the configuration of a filter according to a second embodiment is shown in FIGS. 5A through 5C. FIG. 5A is a plan view of the dielectric substrate, FIG. 5B is a lower view thereof, and FIG. 5C is a cross-sectional view thereof of the portion along the line A-A'.

With the first embodiment, the short-circuit ends of the first and second center electrodes on the upper and lower sides of the dielectric substrate 1 face in opposite directions, but with the example shown in FIGS. 5A through 5C, the short-circuit ends of the first and second center electrodes on the upper and lower sides of the dielectric substrate 1 face in the same direction. In this case as well, the direction of the electric field is vertical through the dielectric substrate, so a high Qo can be obtained.

Figure 6A:
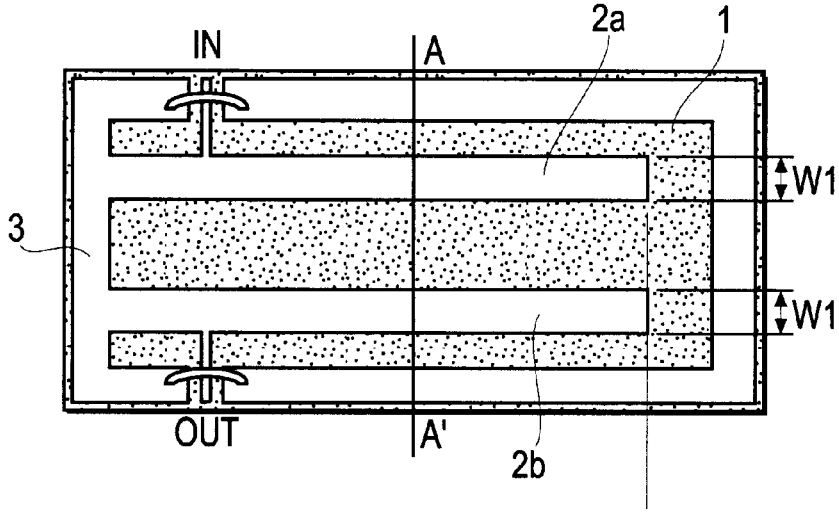
FIGS. 6A through 6C are configuration diagrams illustrating a filter according to a third embodiment.
Figure 6C:
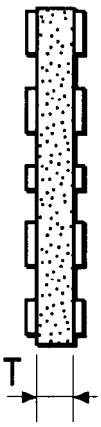
Figure 6B:
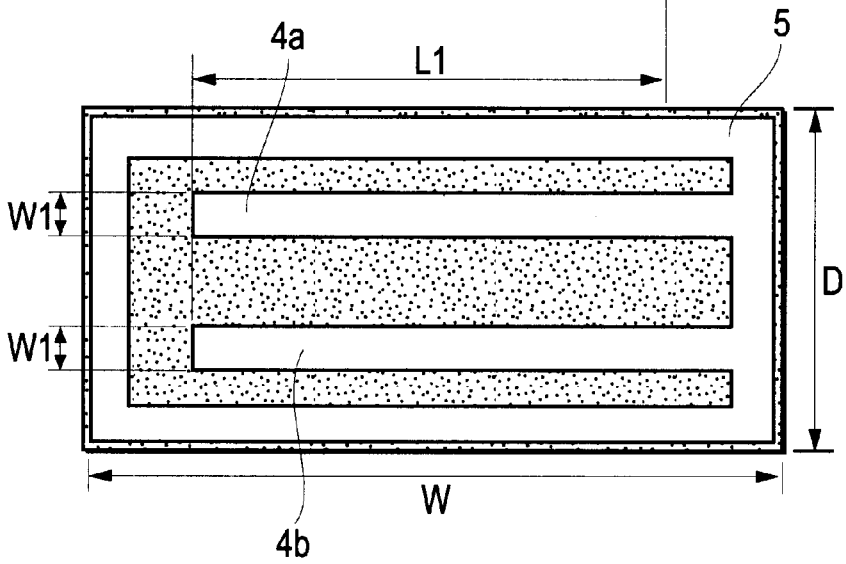

FIGS. 6A through 6C are configuration diagrams of a filter according to a third embodiment. In this example, first center electrodes 2*a* and 2*b* are provided upon the upper side of a dielectric substrate 1, and a ground electrode 3 is formed outside of the center electrodes. In the same manner, second center electrodes 4*a* and 4*b* are provided upon the lower side of the dielectric substrate, and a perimeter electrode 5 is formed outside of these. In the resonance mode with such a structure, the direction of the electric field is vertical through the dielectric substrate. However, there is no ground electrode between the first center electrodes 2*a* and 2*b* arranged in parallel in the plane direction on the dielectric substrate, so the first-tier resonator made up of the first center electrode 2*a* and second center electrode 4*a* and the ground electrode 3 and perimeter electrode 5, and the second-tier resonator made up of the first center electrode 2*b* and the second center electrode 4*b* and the ground electrode 3 and perimeter electrode 5 can be coupled in an even more intense manner.

Figure 7A:
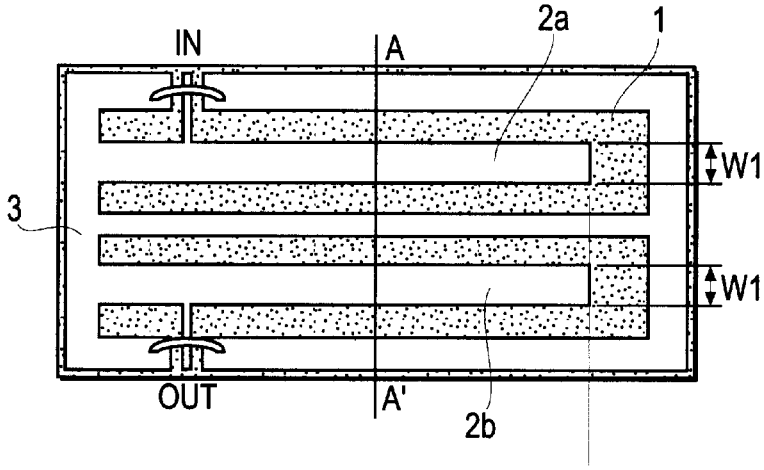
FIGS. 7A through 7C are configuration diagrams illustrating a filter according to a fourth embodiment.
Figure 7C:
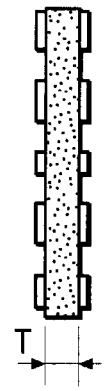
Figure 7B:
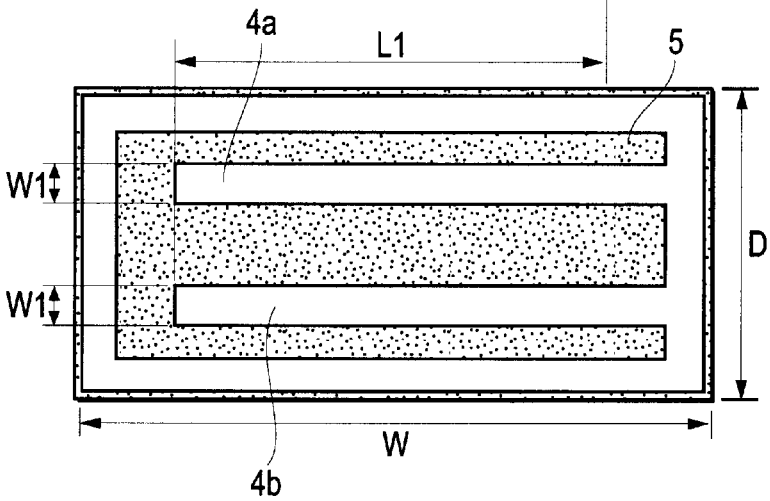

FIGS. 7A through 7C are configuration diagrams of a filter according to a fourth embodiment. With this example, a ground electrode 3 is formed extending outside and between the first center electrodes 2*a* and 2*b* on the upper side of the dielectric substrate 1, and a perimeter electrode 5 is formed extending outside of the second center electrodes 4*a* and 4*b* on the lower side of the dielectric substrate 1. According to this structure, the resonators of the first tier and the second tier can be coupled to a degree partway between the coupling obtained with the filters according to the first and second embodiments and the coupling obtained with the third filter shown in FIGS. 6A through 6C.

Next, the configuration of a filter according to a fifth embodiment will be described with reference to FIGS. 8A through 9.

Figure 8A:
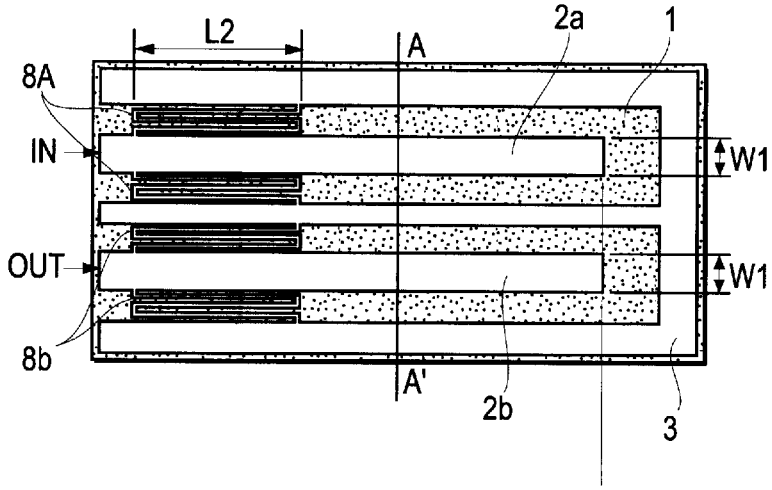
FIGS. 8A through 8C are configuration diagrams illustrating a filter according to a fifth embodiment.
Figure 8C:
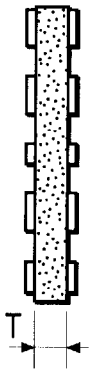
Figure 8B:
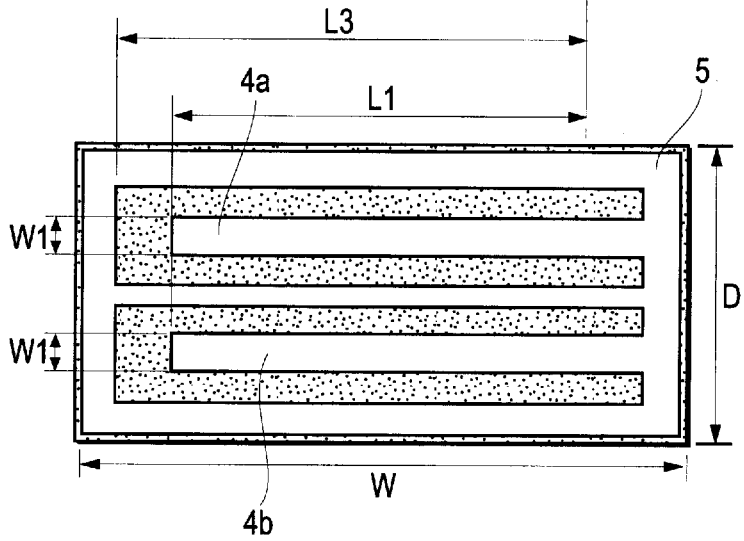

As shown in FIGS. 8A through 8C, first center electrodes 2*a* and 2*b* and a ground electrode 3 are formed on the upper plane of the dielectric substrate 1, and near the other end of the first center electrodes 2*a* and 2*b* opposite to the open end thereof, the first center electrodes 2*a* and 2*b* are connected to the ground electrode 3 via lines 8*a* and 8*b*.

Figure 9:
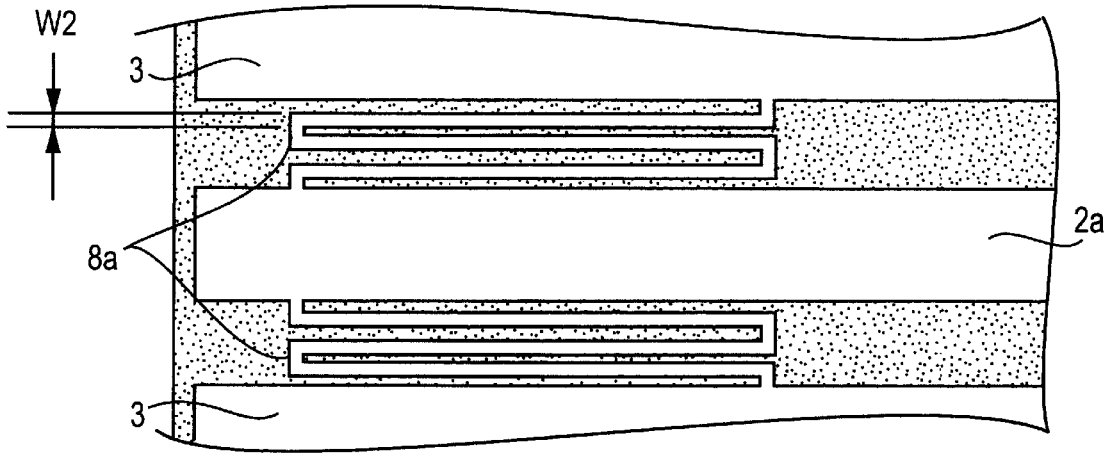
FIG. 9 is a partially enlarged diagram of the filter.

FIG. 9 is an enlarged view of the line portion 8*a*. A meandering line 8*a* with a line width W2 is thus formed between the first center electrode 2*a* and the ground electrode 3 on either side thereof. This is true for the other line 8*b* as well. These lines 8*a* and 8*b* are capable of making external connection by the inductance of the lines 8*a* and 8*b*, and use the ends of the first center electrodes 2*a* and 2*b* which are not the open ends as the input/output portions thereof.

According to this structure, the wires and air bridges and the like (the so-called tap connections) for connecting the non-continuous portions of the ground electrode as shown in FIGS. 1A through 1C are unnecessary, and an external connection structure can be made by the electrode pattern on the dielectric substrate along, so ease of manufacturing thereof is facilitated.

Figure 10:
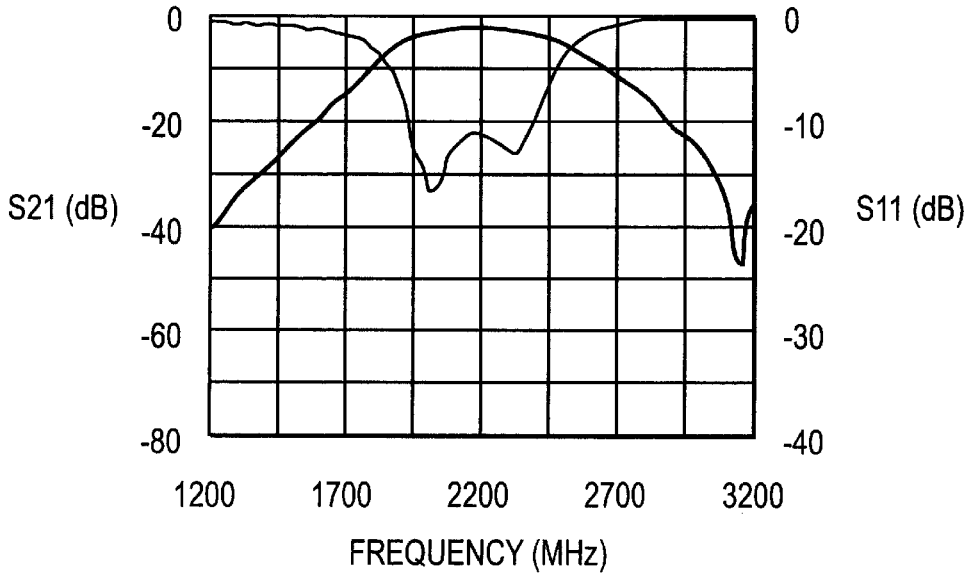
FIG. 10 is a diagram illustrating pass properties and reflecting properties of the filter.

FIG. 10 illustrates the transmission properties and reflection properties of the filter shown in FIGS. 8A through 8C. Thus, even in the event that the center electrodes and ground electrode are connected with lines to make external connection, low-reflection low-insertion-loss properties can be obtained at the pass band.

Figure 11A:
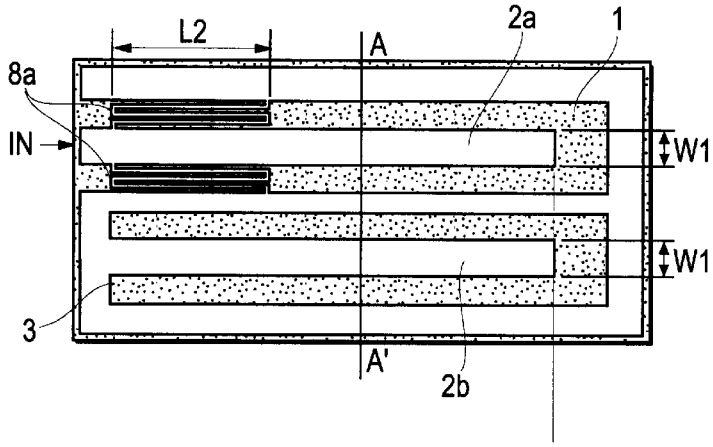
FIGS. 11A through 11C are configuration diagrams illustrating a filter according to a sixth embodiment.
Figure 11C:
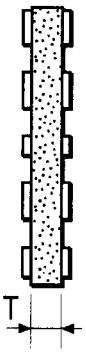
Figure 11B:
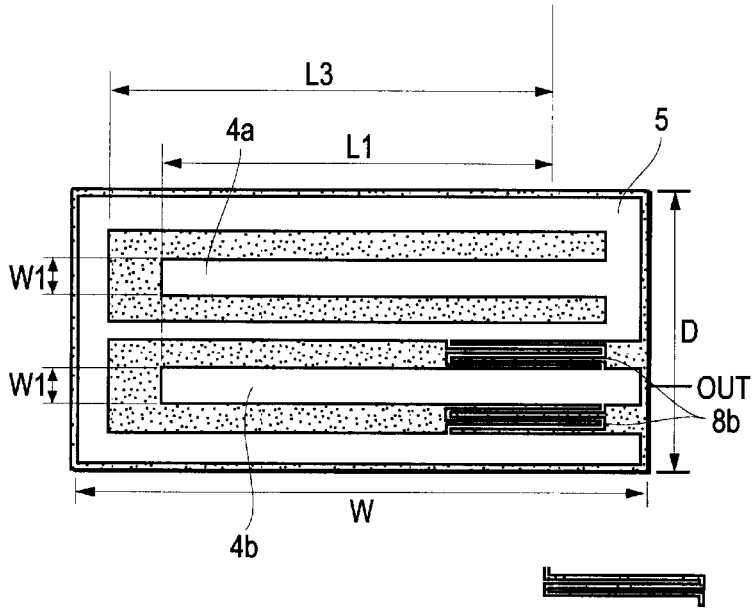

FIGS. 11A through 11C are configuration diagrams of a filter according to a sixth embodiment. With the example shown in FIGS. 8A through 8C, input/output of signals is performed from the other end on the upper plane of the dielectric substrate 1, but with the example shown in FIGS. 11A through 11C, a line 8*a* is provided between the ground electrode 3 and both sides of the first center electrode 2*a* on the upper side of the dielectric substrate 1, and a line 8*b* is provided between the perimeter electrode 5 and both sides of the second center electrode 4*b* on the lower side of the dielectric substrate. Thus, input and output of signals is performed on the upper and lower planes of the dielectric substrate and in opposing directions, thereby markedly securing isolation between input and output.

Figure 14:
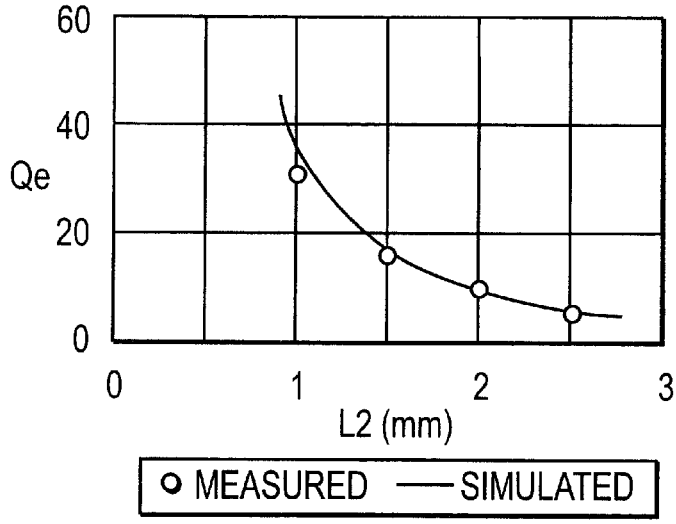
FIG. 14 is a diagram illustrating the relation between the length L2 of the line portions and Qe.

FIG. 14 illustrates the relation of external Q (Qe) as to the length L2 of the line 8*a* and 8*b* portions with the filters shown in FIGS. 8A through 8C and FIGS. 11A through 11C. Here, the length of the dielectric substrate is W=5.2 mm, the width is D=2.5 mm, and the thickness is T=0.2 mm, the width of the lines of the center electrodes is W1=0.3 mm, the width of the lines 8*a* and 8*b* is W2=0.03 mm, and the length wherein the center electrodes on the upper and lower planes of the dielectric substrate overlap is L1=3.5 mm. Thus, Qe can be greatly changed by the length L2 of the lines connecting the center electrodes and the perimeter electrode on either side thereof, so a predetermined degree of external coupling can be determined.

Figure 12A:
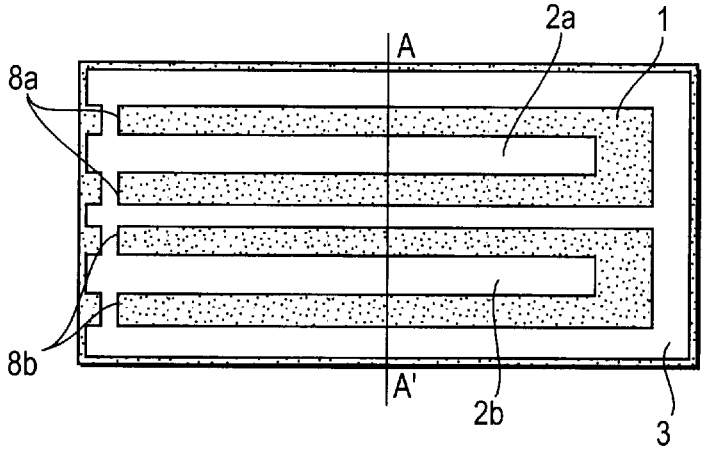
FIGS. 12A through 12C are configuration diagrams illustrating a filter according to a seventh embodiment.
Figure 12C:
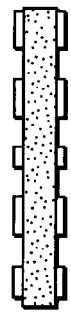
Figure 12B:
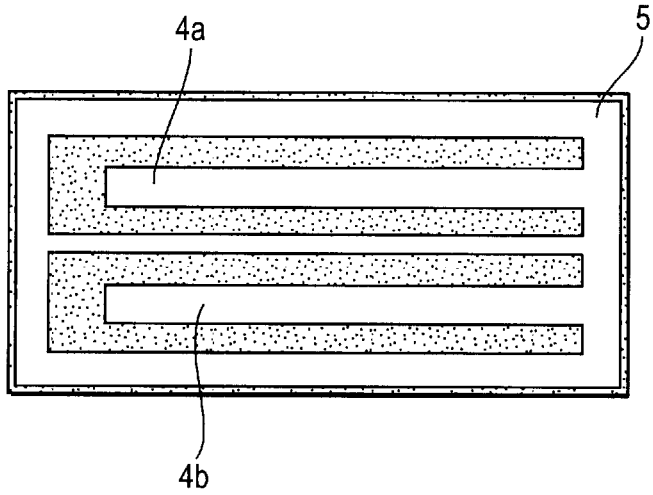

FIGS. 12A through 12C are configuration diagrams of a filter according to a seventh embodiment. This is an example wherein the lines 8*a* and 8*b* shown in FIGS. 8A through 8C have been shortened to a minimal length. That is to say, lines 8*a* and 8*b* are formed between certain positions on the first center electrodes 2*a* and 2*b* and the ground electrode 3 on either side thereof at a minimal length.

Figure 13A:
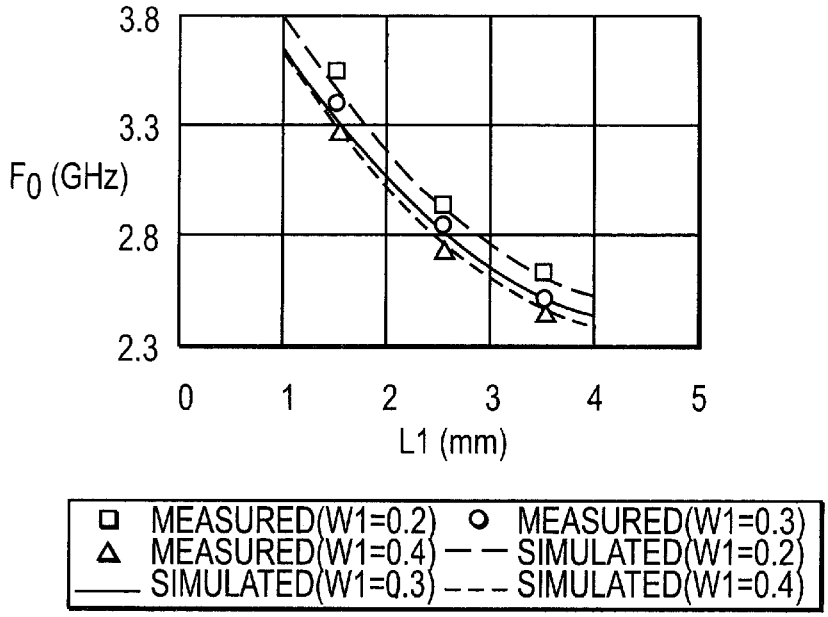
FIGS. 13A and 13B are diagrams illustrating an example of the dimensions of the parts of the filter and change in properties.

FIG. 13A illustrates the relation between the center frequency Fo and the length L1 wherein the first and second center electrodes on the upper and lower planes of the dielectric substrate overlap. Here, the length of the dielectric substrate is W=5.2 mm, the width is D=2.5 mm, and the thickness is T=0.2 mm, the width of the lines 8*a* and 8*b* is W2=0.1 mm, the length of the lines 8*a* and 8*b* is L2=0.1 mm, and the line width of the center electrodes W1 is a parameter. Thus, the center frequency Fo of the filter can be determined by the length L1 wherein the center electrodes on the upper and lower planes of the dielectric substrate each overlap.

Figure 13B:
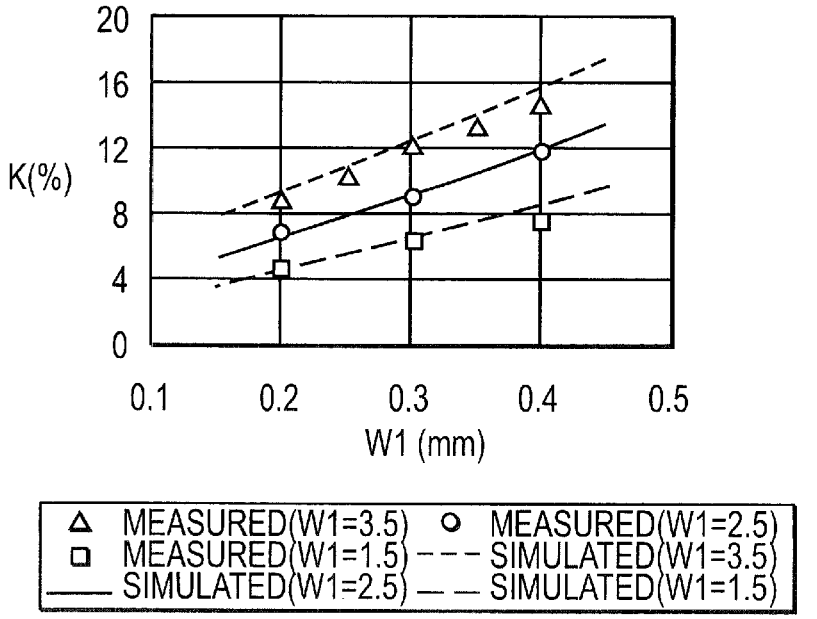

FIG. 13B illustrates the relation of the coupling coefficient K between the resonators as to the width W1 of the center electrodes 2*a*, 2*b*, 4*a*, and 4*b*. Here, W, D, T, W2, and L2 are the same conditions as with FIG. 13A, and the length L1 wherein the center electrodes on the upper and lower planes of the dielectric substrate overlap is a parameter. Thus, the coupling coefficient between the resonators can be determined by the length L1 wherein the center electrodes on the upper and lower planes of the dielectric substrate overlap and the line width W1 of the center electrodes.

With the example in FIGS. 13A and 13B, the condition L2=0.1 is set to reduce external coupling to a low degree, so that the effects of external coupling can be ignored.

Figure 15:
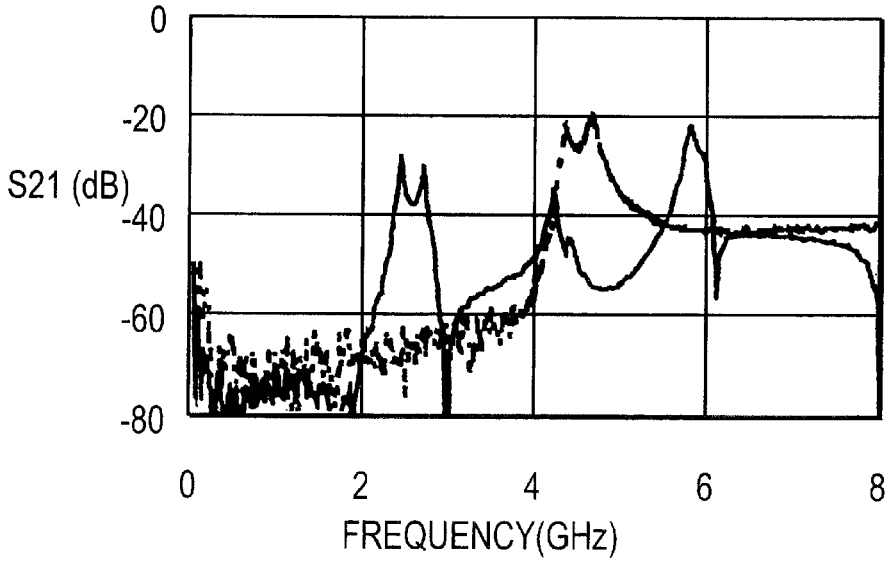
FIG. 15 is a diagram illustrating a comparative example of pass properties of the filter and a conventional filter.

FIG. 15 is a diagram illustrating the transmission properties of the filter shown in FIGS. 12A through 12C. This figure also shows the properties of a filter as shown in FIGS. 12A through 12C with conventional coplanar resonators wherein center electrodes and perimeter electrodes are not provided to the lower plane side of the dielectric substrate. Here, the solid lines represent arrangements according to the embodiment, and the dotted lines represent conventional structures.

The following Table 1 shows the properties of two filters:

TABLE 1

| Type | Mode | f even, f odd [MHz] | Center frequency [MHz] | Qo odd Qo even | Average Qo |
|---|---|---|---|---|---|
| Embodiment | Odd | 2312.76 | 2479.42 | 61.06 | 61.32 |
| | Even | 2646.07 | | 61.58 | |
| Conventional example | Even | 4389.60 | 4545.50 | 56.01 | 46.23 |
| | Odd | 4701.39 | | 36.45 | |

As can be seen here, in the event that the length of the center electrodes are the same, the center frequency is far lower than that in filters using conventional coplanar resonators. At the same time, Qo increases greatly. Accordingly, the line length necessary for obtaining the desired center frequency is shortened, and the overall filter can be reduced in size. Also, increased Qo allows low-loss properties to be obtained. Incidentally, in FIG. 15, the insertion loss is greater for the solid line than for the dotted line, but this is due to effects of external coupling, and is not due to Qo.

Figure 16A:
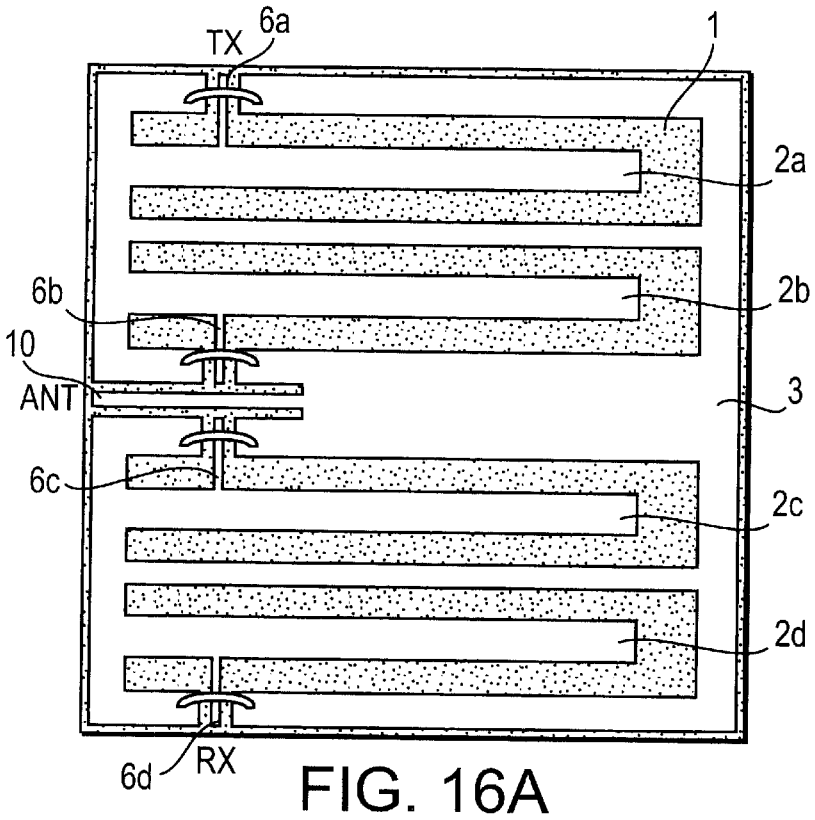
FIGS. 16A and 16B are configuration diagrams illustrating a duplexer according to an eighth embodiment.
Figure 16B:
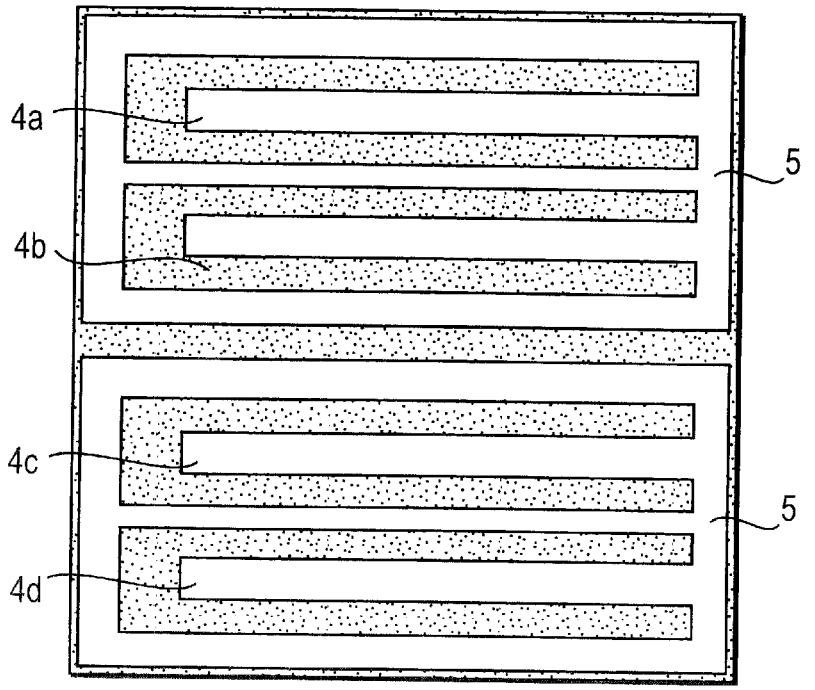

Next, FIGS. 16A and 16B illustrate a configuration example of a duplexer according to an eighth embodiment. FIG. 16A is a plan view, and FIG. 16B is a lower view. First center electrodes 2*a*, 2*b*, 2*c*, and 2*d*, and a ground electrode 3 extending around either side thereof are formed on the upper plane of a dielectric substrate 1. Second center electrodes 4*a*, 4*b*, 4*c*, and 4*d*, are formed on the lower plane of the dielectric substrate, at positions facing the above first center electrodes 2*a*, 2*b*, 2*c*, and 2*d*, respectively, and a perimeter electrode 5 is also formed extending around either side thereof.

Also, input/output electrodes 6*a*, 6*b*, 6*c*, and 6*d* extending perpendicularly from predetermined places on the four first center electrodes are formed on the upper plane of the dielectric substrate 1, and the spaces between the ground electrodes on either side of these input/output electrodes are connected with wires. Further, an input/output electrode 10 wherein one end serves as an antenna port ANT and the other end connects to the ground electrode 3 is formed, and the input/output electrodes 6*b* and 6*c* are connected to predetermined places on this input/output electrode 10.

The two-tier coplanar line resonator made up of the first and second center electrodes 2*a*, 2*b*, 4*a*, and 4*b*, and the ground electrode 3 and perimeter electrode 5 positioned from the center electrodes by a certain distance, as shown in FIGS. 16A and 16B, is used as a transmission filter, and the two-tier coplanar line resonator made up of the first and second center electrodes 2*c*, 2*d*, 4*c*, and 4*d*, and the ground electrode 3 and perimeter electrode 5 positioned from the center electrodes by a certain distance, is used as a reception filter. Thus, an antenna duplexer is configured wherein the input/output electrode 6*a* serves as the transmission signal input port TX, and wherein the input/output electrode 6*d* serves as the reception signal output port RX.

Incidentally, with the example shown in FIGS. 16A and 16B, the perimeter electrodes 5 on the lower plane side of the dielectric substrate are separated between the transmission filter portion and the reception filter portion, so isolation can be increased for each of the filters.

Next, the configuration of a filter according to a ninth embodiment will be described with reference to FIGS. 17A and 17B and FIG. 18.

Figure 17A:
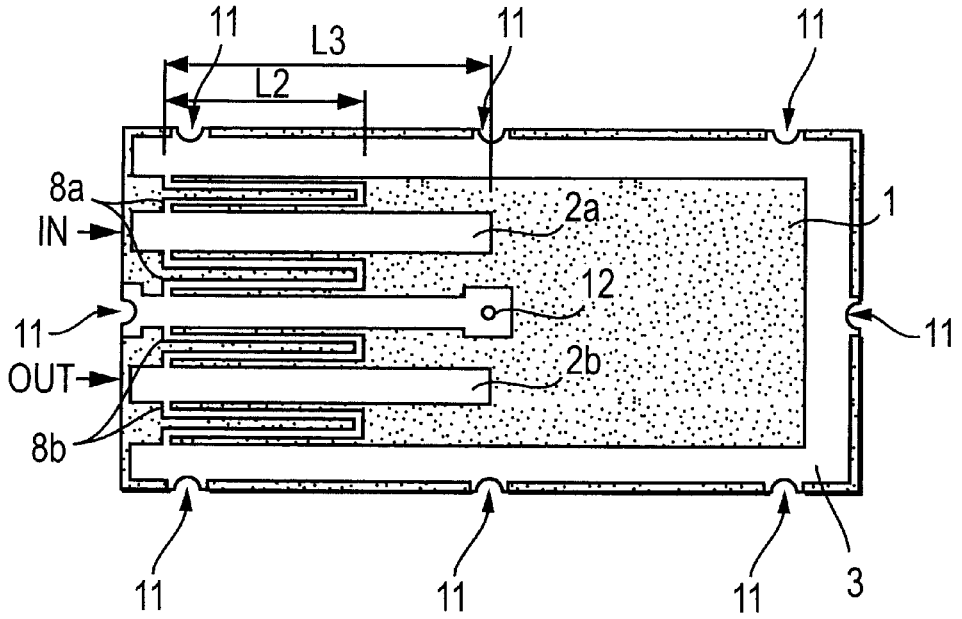
FIGS. 17A and 17B are configuration diagrams illustrating a filter according to a ninth embodiment.
Figure 17B:
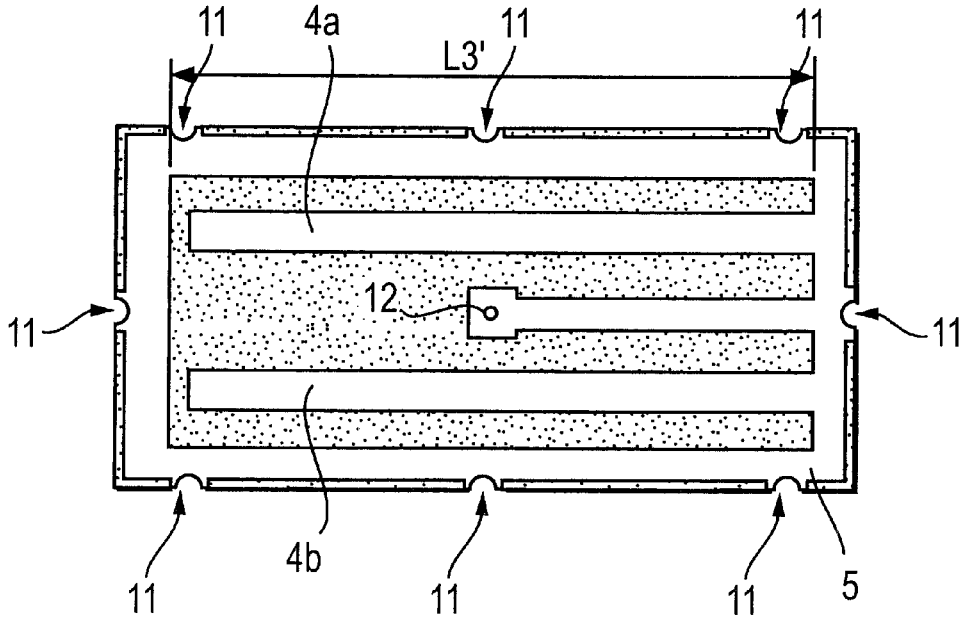

With this example, as shown in FIGS. 17A and 17B, two mutually parallel first center electrodes 2*a* and 2*b* each having open ends, and a ground electrode 3 positioned a certain distance therefrom, are formed on the upper plane of a dielectric substrate 1.

Second center electrodes 4*a* and 4*b*, and a perimeter electrode 5 are formed on the lower plane of the dielectric substrate 1, at positions facing the upper plane first center electrodes 2*a* and 2*b*, and the ground electrode 3. Note however, that the electrode patterns are formed with the short-circuit end of the first center electrodes 2*a* and 2*b* on the upper side of the dielectric substrate 1 and the short-circuit end of the second center electrodes 4*a* and 4*b* on the lower side thereof facing in opposite directions, with the length of the first center electrodes 2*a* and 2*b* on the upper plane as L3 and the length of the second center electrodes 4*a* and 4*b* on the lower plane as L3'. Also formed on the upper side of the dielectric substrate 1 are lines 8*a* and 8*b* connecting the first center electrodes 2*a* and 2*b* with the ground electrode 3 on either side thereof. These lines 8*a* and 8*b* are formed as meandering lines over a length L2 which is shorter than L3. According to this structure, external connection is made by the inductance of the lines 8*a* and 8*b*, and the ends of the first center electrodes 2*a* and 2*b* opposite to the open ends are used as the input/output portions thereof.

Multiple via holes 11 for connecting the perimeter electrodes on the upper and lower planes are provided on the perimeter of the dielectric substrate 1. Also, a via hole 12 for connecting the ground electrode positioned between the first center electrodes 2*a* and 2*b* and the perimeter electrode positioned between the second center electrodes 4*a* and 4*b* is formed approximately at the center of the dielectric substrate.

Thus, connecting the ground electrode and perimeter electrode on the upper and lower planes of the dielectric substrate together by the via holes 11 and 12 enables suppression of spurious response due to the electrode patterns on the upper and lower planes of the dielectric substrate. Particularly, positioning the via hole 12 at the center of the dielectric substrate 1 is effective in suppressing spurious response due to the ground electrode or perimeter electrode at the center portion of the dielectric substrate between the center electrodes.

The above via holes may be formed by processes which include the steps of (1) forming holes in the perimeter of the chip to be cut out as a filter while in the wafer state of the dielectric ceramic substrate, (2) forming electrodes within the holes, and (3) dividing the wafer into individual chips by dicing.

The via holes can be formed by methods of working the ceramic substrate after baking with laser tools such as a carbon dioxide gas laser or YAG laser or the like, ultrasound tools, etc.; or methods in which the substrate is baked following opening holes in the ceramic green sheet.

A further advantage of the embodiment shown in FIGS. 17A and 17B is to allow a spurious response to be shifted to a sufficiently high frequency, without changing the main frequency of the filter. This is because shortening the length L3 of the first center electrodes 2*a* and 2*b* on the upper side of the dielectric substrate and lengthening the length L3' of the second center electrodes 4*a* and 4*b* on the lower side thereof enables that spurious response, which has an electromagnetic field distribution similar to that of a $\lambda/4$ CPW (a coplanar wave guide which resonates at ¼ wavelength), to be shifted to a higher frequency. This is because, while the main resonance mode of the filter depends on the electrodes on both sides of the dielectric substrate, the spurious response having the electromagnetic field distribution similar to that of the $\lambda/4$ CPW filter is strongly dependent on only the upper side of the dielectric substrate.

Figure 18:
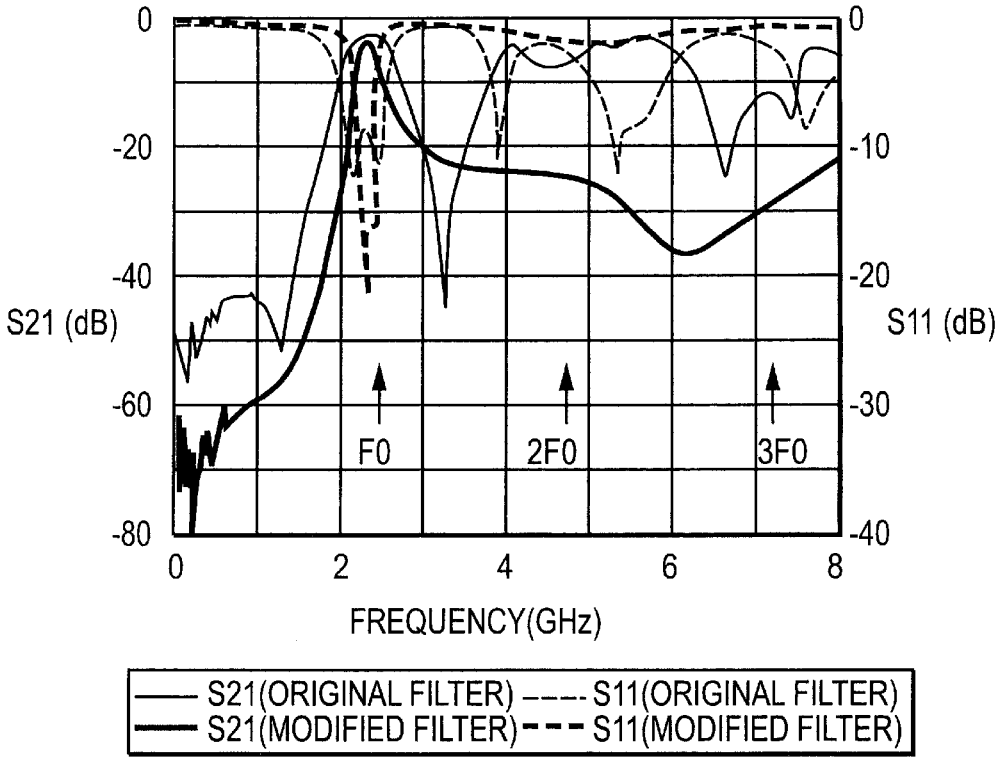
FIG. 18 is a diagram illustrating an example of properties of the filter.

FIG. 18 illustrates a comparison in transmission properties and reflection properties between a filter wherein spurious response has been suppressed by the via holes shown in FIGS. 17A and 17B and a normal filter without via holes. Here, S21 represents transmission properties and S11 represents reflection properties, (original filter) indicates that the filter is a normal filter without via holes, and (modified filter) indicates that the filter is a filter wherein spurious response has been suppressed by via holes. It can be understood from this diagram that spurious response properties have been markedly improved. At twice the center frequency F0 of this filter (2F0), the amount of attenuation is 24.2 dB, and the amount of attenuation is 29.6 dB at three times (3F0), showing that sufficient spurious response suppression is exhibited.

Next, the configuration of a filter according to a tenth embodiment will be described with reference to FIGS. 19A and 19B and FIG. 20.

With the ninth embodiment, a filter is configured of two tiers of resonators, but three or more tiers of resonators can be used to configure the resonator in the same manner. Generally, attenuation properties can be improved by increasing the number of tiers of the filter. However, with the transmission properties of a filter made up of three tiers of resonators, the spurious response occurs near the high range side of the filter band, and accordingly attenuation properties can be improved only with difficulty. With this tenth embodiment, however, three tiers of resonators are formed and a spurious response is suppressed, thereby improving attenuation properties.

Figure 19A:
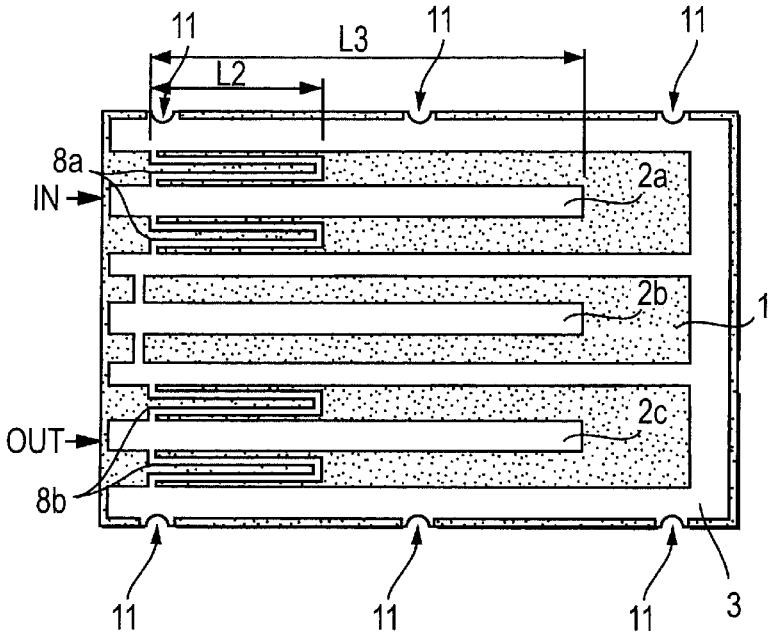
FIGS. 19A and 19B are configuration diagrams illustrating a filter according to a tenth embodiment.
Figure 19B:
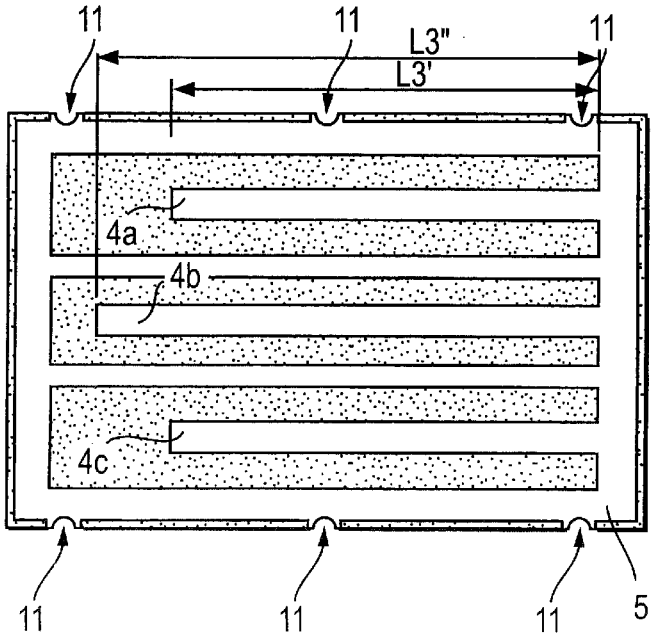

As shown in FIGS. 19A and 19B, formed on the upper side of the dielectric substrate 1 are mutually parallel first center electrodes 2*a*, 2*b*, and 2*c*, having open ends, and a ground electrode 3 along both sides of each of these first center electrodes. Also, formed on the lower side of the dielectric substrate 1 are second center electrodes 4*a*, 4*b*, and 4*c*, and a perimeter electrode 5, at positions facing the first center electrodes 2*a*, 2*b*, and 2*c* and the ground electrode 3 on the upper plane, respectively. In this example, the length of the first center electrodes 2*a*, 2*b*, and 2*c* is L3, the length of the second center electrodes 4*a* and 4*c* on the lower plane is L3', and the length of 4*b* is L3", which is longer than L3' in this example, so that the overlapping length of the center electrodes on the upper side and lower differs between the first and third tiers and the second tier. Also, meandering lines 8*a* and 8*b* are formed on the upper plane of the dielectric substrate 1 so as to connect the first center electrodes 2*a* and 2*c* and the ground electrodes 3 on either side thereof.

Multiple via holes 11 for connecting the ground electrode and perimeter electrode on the upper and lower planes are provided on the perimeter of the dielectric substrate 1. Connecting electrodes on the upper and lower planes of the dielectric substrate by the via holes 11 enables suppression of spurious response due to the electrode patterns on the upper and lower planes of the dielectric substrate.

In this example, the external connection of the filter may be optimized by adjusting the number of switchbacks of the lines 8*a* and 8*b*.

Figure 20:
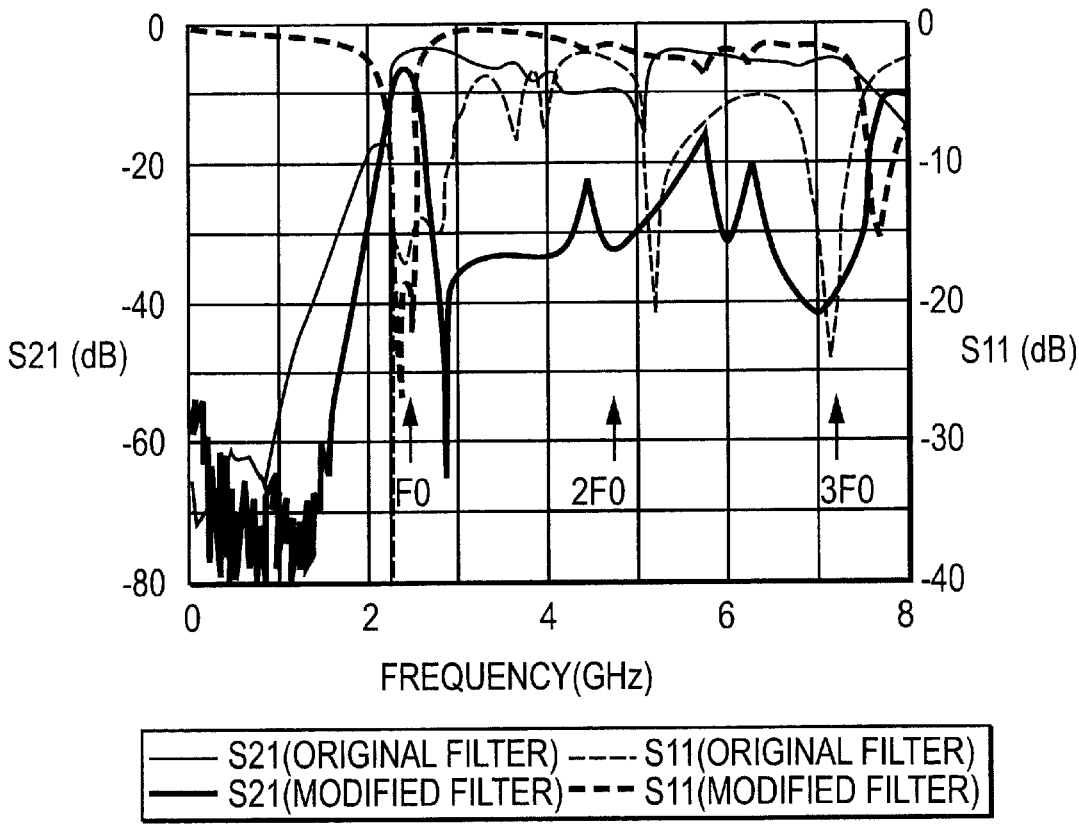
FIG. 20 is a diagram illustrating an example of properties of the filter.

FIG. 20 illustrates a comparison in transmission properties and reflection properties between a filter wherein spurious response has been suppressed by the via holes shown in FIGS. 19A and 19B and a normal filter without via holes. Here, S21 represents transmission properties and S11 represents reflection properties, (original filter) indicates that the filter is a normal filter without via holes, and (modified filter) indicates that the filter is a filter wherein spurious response has been suppressed by via holes. It can be understood from this diagram that spurious response properties have been markedly improved with the filter having via holes formed therein, in the same manner as with the filter made up of two tiers of resonators. At twice the center frequency F0 of this filter (2F0), the amount of attenuation is 31.2 dB, and the amount of attenuation is 38.4 dB at three times (3F0), showing that sufficient spurious response suppression is exhibited. In this way, spurious response properties have been improved regardless of this being a three-tier resonator filter, so that various applications are made possible with this filter.

Next, a configuration example of a communication device according to an eleventh embodiment will be described with reference to the block diagram shown in FIG. 21.

Figure 21:
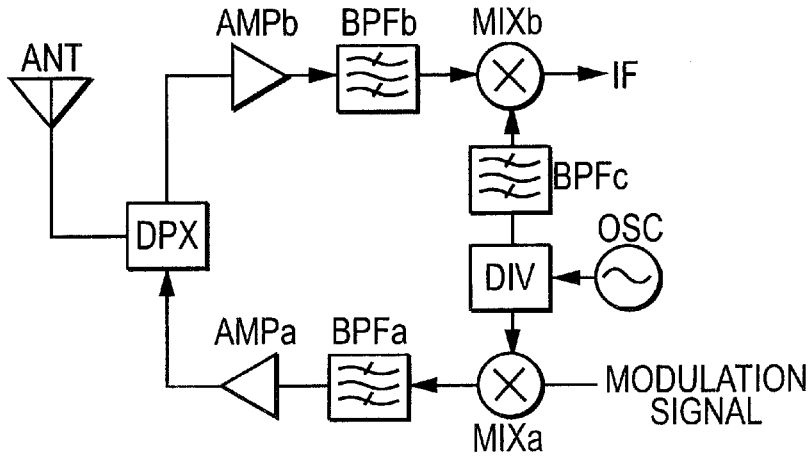
FIG. 21 is a block diagram illustrating the configuration of a communication device relating to a eleventh embodiment.

In FIG. 21, ANT denotes a transmission/reception antenna, DPX denotes a duplexer, BPFa, BPFb, and BPFc each denote band pass filters, AMPa and AMPb each denote amplifying circuits, MIXa and MIXb each denote mixers, and DIV denotes a divider (synthesizer). OSC denotes a voltage-control oscillator which modulates oscillation frequencies to generate transmission signals according to transmission data.

The MIXa modulates frequency signals output from the DIV according to the modulation signals, the BPFa passes only the transmission frequency band, the AMPa subjects this to electric power amplification and the signals are transmitted from the ANT via the DPX. The AMPb amplifies reception signals output from the DPX. Of the amplified signals, the BPFb passes only the reception frequency bandwidth. The MIXb mixes the frequency signals output from the BPFc with the reception signals, and outputs intermediate frequency signals IF.

The duplexer shown as the eighth embodiment may be used as the duplexer DPX part shown in FIG. 21. Also, the dielectric filters shown as the first through seventh embodiments may be used for the band pass filters BPFa, BPFb, and BPFc. Thus, a compact communication device with excellent high-frequency circuit properties can be obtained by using compact filters or duplexers which pass desired frequency bands with low insertion loss.

According to the present invention, the dimensions of the electrode patterns for obtaining a predetermined resonance frequency and the dimensions of the dielectric substrate can be reduced in size, and further, filter properties with low insertion loss can be obtained and the no-load Q of the resonator is increased.

Also, according to the present invention, the need for connection of the non-continuous portions of the perimeter electrode with wires or air bridges, and parts for generating electrostatic capacitance, are done away with, and input/output of signals can be performed with electrode patterns on the upper side of the dielectric substrate alone, thereby facilitating ease of manufacturing.

Also, according to the present invention, via holes are formed for conduction between the ground electrode on the upper plane and the perimeter electrode on the lower plane of the dielectric substrate, so spurious response can be suppressed, and excellent conducting properties and reflecting properties can be obtained.

Also, according to the present invention, the above filters and duplexer may be used for processing transmission signals or reception signals in a high-frequency circuit part for example, thereby obtaining high electric usage efficiency properties with a small size.

Although the present invention has been described in relation to particular embodiments thereof, many other variations and modifications and other uses will become apparent to those skilled in the art. Therefore, the present invention is not limited by the specific disclosure herein.

What is claimed is:

1. A coplanar line filter, comprising:

a dielectric substrate having an upper plane and a lower plane;

a coplanar resonator provided upon the upper plane of said dielectric substrate, said coplanar resonator comprising:

a first center electrode wherein an end thereof is an open end, and a ground electrode spaced away from said first center electrode by a predetermined gap;

a second center electrode provided on the lower plane of said dielectric substrate, formed so as to face said first center electrode through said dielectric substrate; and a perimeter electrode provided on the lower plane of said dielectric substrate, formed so as to face said ground electrode through said dielectric substrate, wherein the first center electrode and the second center electrode form a ring resonator.

2. A coplanar line filter according to claim 1, wherein at least one additional coplanar resonator is arranged on the upper plane of said dielectric substrate in parallel with respect to said coplanar resonator.

3. A coplanar line filter according to claim 2, further comprising ground conducting members connected to said ground electrode and provided between said coplanar resonator and said additional coplanar resonator.

4. A coplanar line filter according to claim 1, wherein said ground electrode on the upper plane and said perimeter electrode on the lower plane are connected together.

5. A coplanar line filter according to claim 4, wherein said ground electrode and said perimeter electrode are connected by via holes passing through the upper plane and lower plane of said dielectric substrate.

6. A coplanar line filter according to claim 1, wherein said first center electrode of the upper plane and said second center electrode of the lower plane are mutually coupled electromagnetically.

7. A coplanar line filter according to claim 1, wherein said first center electrode and said ground electrode are connected near ends thereof which are opposite to said open end of said first center electrode.

8. A coplanar line filter according to claim 7, wherein said first center electrode and said ground electrode are connected by a meandering line.

9. A communication device comprising a coplanar line filter according to any one of the claims 1 through 8, said coplanar line filter having an input/output terminal, and further comprising at least one of a transmission circuit and a reception circuit connected to said input/output terminal of said coplanar line filter.

* * * * *